US009192232B2

(12) United States Patent
Park et al.

(10) Patent No.: US 9,192,232 B2
(45) Date of Patent: Nov. 24, 2015

(54) RETAINER FOR SLIDING DEVICE PROVIDED WITH BUFFER MEMBER

(75) Inventors: Yoon Sik Park, Seoul (KR); Jae Won Kim, Incheon (KR)

(73) Assignee: SEGOS CO., LTD., Incheon (KR)

( * ) Notice: Subject to any disclaimer, the term of this patent is extended or adjusted under 35 U.S.C. 154(b) by 0 days.

(21) Appl. No.: 13/885,658

(22) PCT Filed: Nov. 15, 2011

(86) PCT No.: PCT/KR2011/008733
§ 371 (c)(1),
(2), (4) Date: May 15, 2013

(87) PCT Pub. No.: WO2012/067416
PCT Pub. Date: May 24, 2012

(65) Prior Publication Data

US 2013/0230262 A1 Sep. 5, 2013

(30) Foreign Application Priority Data

Nov. 15, 2010 (KR) ..... 10-2010-0113251
Jan. 13, 2011 (KR) ..... 10-2011-0003581

(51) Int. Cl.
*A47B 88/00* (2006.01)
*A47B 88/04* (2006.01)

(52) U.S. Cl.
CPC ..... *A47B 88/04* (2013.01); *A47B 2210/0018* (2013.01); *A47B 2210/0029* (2013.01); *A47B 2210/0097* (2013.01)

(58) Field of Classification Search
USPC ..... 312/334.44–334.47; 384/18, 20–21
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 5,181,781 | A * | 1/1993 | Wojcik | 384/21 |
| 5,181,782 | A * | 1/1993 | Wojcik | 384/21 |
| 6,244,678 | B1 * | 6/2001 | Dopp et al. | 312/333 |
| 6,254,210 | B1 * | 7/2001 | Parvin | 312/334.46 |
| 6,280,086 | B1 * | 8/2001 | Stijns | 384/18 |
| 6,435,636 | B1 * | 8/2002 | MacMillan | 312/334.46 |
| 6,926,377 | B2 * | 8/2005 | Lammens et al. | 312/333 |
| 2006/0279187 | A1 * | 12/2006 | Yang et al. | 312/333 |

(Continued)

FOREIGN PATENT DOCUMENTS

| | | | | |
|---|---|---|---|---|
| EP | 488471 | A2 * | 6/1992 | A47B 88/04 |
| KR | 10-2007-0113414 | A | 11/2007 | |

(Continued)

OTHER PUBLICATIONS

International Search Report for PCT/KR2011/008733.

*Primary Examiner* — Hanh V Tran
(74) *Attorney, Agent, or Firm* — The PL Law Group, PLLC

(57) ABSTRACT

A retainer for a sliding device provided with a buffer member includes a body which is arranged between sliding rails, and has buffering insertion grooves on one side that are open in the outward direction, which is the withdrawal direction, and on the other side, which is the closing direction, so as to adjust the range of withdrawal when the sliding rails are withdrawn; and buffer member portions protruding from the two ends of the body, respectively, in the direction of an accommodation body, and being arranged so as to be respectively inserted into the buffering insertion grooves for coming into contact when the sliding rails are withdrawn.

5 Claims, 13 Drawing Sheets

(56) References Cited

U.S. PATENT DOCUMENTS

| | | | | |
|---|---|---|---|---|
| 2007/0040485 | A1* | 2/2007 | Tseng et al. | 312/333 |
| 2007/0080616 | A1* | 4/2007 | Lam et al. | 312/334.6 |
| 2012/0301062 | A1* | 11/2012 | Huang | 384/21 |
| 2013/0193824 | A1* | 8/2013 | Koenig et al. | 312/334.11 |

FOREIGN PATENT DOCUMENTS

| | | | |
|---|---|---|---|
| KR | 10-2008-0014554 | A | 2/2008 |
| KR | 10-0895139 | B1 | 5/2009 |

* cited by examiner

RETAINER FOR SLIDING DEVICE PROVIDED WITH BUFFER MEMBER

CROSS REFERENCE TO RELATED APPLICATIONS AND CLAIM OF PRIORITY

This patent application is a National Phase application under 35 U.S.C. §371 of International Application No. PCT/KR2011/008733, filed Nov. 15, 2011, which claims priority to Korean Patent Application Nos. 10-2010-0113251 filed Nov. 15, 2010, and 10-2011-0003581 filed Jan. 13, 2011, entire contents of which are incorporated herein by reference.

TECHNICAL FIELD

The present invention relates to a retainer for a sliding device provided with a buffer member.

BACKGROUND ART

In general, a piece of furniture, such as a desk or closet, or a home appliance, such as a refrigerator, a washing machine or a microwave oven, is provided with a receptacle which is pushed in and pulled out in a state in which an object is contained therein. A body of the furniture or home appliance has an accommodating space, and the receptacle having an inner space in which the object is contained is slidably coupled via a sliding device, which is disposed on both sides thereof, such that it can slide into and out of the accommodating space.

A typical sliding device is disposed between the body and the receptacle, in which a rail fixed to the body and a rail which moves along with the receptacle are disposed such that they overlap each other. Rolling means such as balls or rollers are disposed between the overlapping rails such that the fixed rail and the movable rail come into rolling-contact with each other.

In this sliding device, the rolling means is disposed between the rail of the receptacle and the rail of the body such that the receptacle moves via rolling when it is pulled out and pushed in. Accordingly, the receptacle can be smoothly opened and closed when it is pulled out and pushed in. In addition, the rails have a double structure that includes the rail fixed to the body and the rail fixed to the receptacle. In order to increase the length to which the receptacle is pushed out, a triple rail structure in which an intermediate rail is disposed between the fixed rail and the movable rail can be provided. Since the sliding structure is identical irrespective of the double or triple rail structure, it is apparent to a person having ordinary skill in the art that these structures belong to the same category.

The rolling means disposed between the overlapping rails in the sliding device includes a retainer which allows a plurality of balls or rollers to stay in the same interval in the state in which they are disposed at positions where they come into rolling-contact with each other.

A typical retainer is disposed between the fixed rail and the movable rail, and has a configuration that minimizes interference during movement. A plurality of rolling members, such as balls and rollers, are inserted at positions where the fixed rail and the movable rail overlap each other, and stay at predetermined intervals.

Specifically, in the sliding device, the rail fixed to the body has the shape of a letter "C," and the rail which moves along with the receptacle has the same shape such that it can be inserted into the open portion. Accordingly, the retainer which is inserted into the fixed rail and the movable rail has the same shape so as not to interfere with either of them.

In addition, the rolling members fitted to the retainer, which is inserted at a position where the movable rail overlaps the fixed rail at protruding surfaces which face each other, can come into rolling-contact with both of the fixed rail and the movable rail.

In addition, the retainer disposed between the fixed rail and the movable rail has the function of supporting the rolling members and limiting the length to which the movable rail, which slides on the fixed rail in the overlapping fashion, is pulled out in order to prevent the movable rail from be dislodged to the outside. Specifically, the retainer moves in rolling-contact between the fixed rail and the movable rail, and has a protrusion at one end in the pulling-out direction, the protrusion preventing the retainer from being dislodged. The movable rail also has a protrusion which is held by the retainer in order to prevent dislodgment. In other words, when the receptacle is pulled out, one side of the retainer in the pulling-out direction is held by the protrusion on the fixed rail, thereby preventing the retainer and the movable rail from being dislodged to the outside. In addition, the other side of the retainer in the closing direction is held by the protrusion on the movable rail, thereby limiting the length to which the receptacle slides when it is pushed in.

Such a retainer has the following problems: When the receptacle is pulled out, both sides of the receptacle are held by the protrusions on the rails. An impact is thereby transferred to the receptacle, thereby generating noise. In addition, damage may occur due to repeated impact.

In addition, a typical retainer is strong enough to withstand an impact transferred thereto, since it is made of the same metal material as the rails. However, when the rail moves, the rolling members which are disposed for rolling movement are rubbed against the metal-made retainer, thereby creating noise. This may also damage the rolling members.

In addition, the retainer made of the metal material must be formed such that it has the shape of a letter "C" corresponding to the shape of the rails and that the rolling members can be inserted into opposing surfaces so that they can roll. This makes machining difficult, thereby increasing the machining cost. When the metal material is exposed to moisture, corrosion occurs, and frictional sound is produced thereby. During a pulling out action, the retainer collides against with the rails made of the same metal material, thereby creating noise.

Accordingly, recently, a retainer has been made of a synthetic resin material in order to reduce noise due to friction against the rolling members and minimize the damage of the rolling members.

However, the retainer of the related art is less strong than the metal material in terms of withstanding an impact that occurs during a pulling out action. When the receptacle is repeatedly pulled out, the retainer may be easily broken by impact that is transferred thereto, which is problematic.

In addition, in the retainer of the related art, when the receptacle is pulled out, both sides of the retainer collide against the protrusions on the rails so that the rail is prevented from being dislodged and the length to which the receptacle is pulled out is changed. At this time, noise is produced to due to impact, which is problematic.

Furthermore, when the receptacle is pulled out, an impact is created as the retainer of the related art collides against the rail. The impact is concentrated at the contact surface, which may be broken when an impact repeatedly occurs due to continuous pulling-out actions, which is problematic.

SUMMARY

Accordingly, the present invention has been made keeping in mind the above problems occurring in the related art, and is intended to provide a retainer for a sliding device provided with a buffer member, in which the buffer member provided in the retainer which is disposed in the sliding device can minimize noise and increase the longevity of the retainer.

In an aspect, the present invention provides a retainer for a sliding device provided with a buffer member. The retainer adjusts a length to which a receptacle is pulled out, the receptacle has an object contained therein, slides on sliding rails into a body in which the object is to be accommodated, and is pulled out and closed, and rolling members are supported between the sliding rails so as to roll. The retainer includes: a body which is disposed between the sliding rails, and has buffering insertion recesses at one side and the other side, the buffering insertion recesses being open in outward directions such that a length to which one sliding rail is pulled out is adjusted; rolling support brackets which protrude from both ends of the body in directions toward the receptacle such that the rolling support brackets are positioned in opposing directions between the sliding rails, each of the rolling support brackets has a plurality of rolling insertion holes which are arranged in a pulling-out direction and into which the rolling members are inserted so as to be supported thereby; and buffer members which are disposed at an end in the pulling-out direction and at an end in a closing direction of the sliding rails, and are inserted into the buffering insertion recesses so as to contact when the one sliding rail is pulled out. The buffer members are disposed at one side and the other side of the body which are held and supported when the one sliding rail which is in rolling-contact with the rolling members is pulled out, thereby buffering an impact that is caused by a pulling-out force when the body is held and supported.

The retainer may further include buffering supports arranged at one side and the other side of the body. The buffering supports protrude to distanced positions in directions from opposing inner surfaces toward a center such that insertion spaces are formed in the buffering insertion recesses, and have support surfaces which are formed in directions toward the opposing surfaces of the buffering insertion recesses such that the insertion spaces are expanded in a direction toward the body and support slopes which are tapered such that a cross-sectional area thereof decreases in a direction from both ends of the support surfaces toward the body, the support slopes defining support spaces extending from the insertion spaces to the support slopes. The size of the support spaces is decreased in the direction toward the body compared to the size of the insertion spaces.

Each of the buffer members may include a first buffering body which is disposed at an either one of one side and the other side of the body, the first buffering body having first insertion support recesses which are formed in both sides thereof, the first insertion support recesses being opened in directions from the opposing inner surfaces toward both sides and in the direction toward the body such that a corresponding one of the buffering support, which protrudes from a corresponding one of the opposing inner surfaces of the buffering insertion recess in the direction toward the center, is inserted thereinto; and first buffering protrusions which are formed inside the first buffering body so as to protrude, and each of which has a first protrusion slope which protrudes from a corresponding inner surface of the first insertion support recesses in a direction toward either one of the opposing surfaces of the buffering insertion recess, a cross-section of the first protrusion slope decreasing in the direction toward the body such that the first protrusion slope comes into contact with the support surface depending on a degree of inclination of the support slope, such that the first buffering protrusions protrude so as to be inserted into the support spaces. The buffering support is inserted into the first insertion support recess when the first buffering body 131 inserted into the insertion space, the first buffering protrusions which protrude inside the first insertion support recess are deformed inside the first elastic recesses which are formed in a central portion, and pass through the insertion spaces which are smaller than an erected size of the protrusions, such that the first buffering protrusions are inserted into the support spaces and come into contact with and are supported by inner surfaces of the support spaces.

The first buffering body may have a recess-shaped first elastic hole which is formed in the central portion in the direction toward the body, the space of the first elastic hole being to be deformed by elasticity, first slopes which are inclined in directions from the central portion of the surface facing outward of the body toward both sides and toward the body, and a first buffering hole which is formed in the central portion in an outward direction of the body. The first buffering body is insertable into the support space as an inner portion of the first elastic hole is deformed by elasticity when the first buffering protrusions pass through the insertion spaces. When the receptacle is pulled out, the first buffering bodies at one side and the other side come into contact with the sliding rails, such that an impact is dispersed at the first slopes and is absorbed to the first buffering hole as the inner portion of the first buffering hole is deformed.

The retainer may further include buffering protrusion parts which are arranged at one side and the other side of the body. The buffering protrusion parts protrude to distanced positions in directions from opposing inner surfaces in the buffering insertion recesses toward a center, thereby forming protrusion spaces. Each of the buffering protrusion parts having support recesses in both surfaces in directions toward the sliding rails at a central position in a direction toward the body. The buffering protrusion parts are disposed such that the second buffer members are inserted into the protrusion spaces and are inserted into the support recesses which are formed in both surfaces facing toward the sliding rails.

Each of the buffering protrusion parts may include: a second buffering body which is arranged at an either one of one side and the other side of the body, and has second insertion support recesses which are opened in directions from the opposing inner surfaces toward both sides and in the direction toward the body such that a corresponding one of the buffering protrusion parts, which protrudes from the opposing inner surfaces of the buffering insertion recess in the direction toward the center, is inserted thereinto; and second buffering protrusions which are formed inside the second buffering body so as to protrude, and each of which protrudes from the opposing inner surfaces of the second insertion support recesses in directions toward the central portion such that the second buffering protrusions are inserted into the support recesses. When second buffering body is inserted into the protrusion space, the buffering protrusion part is inserted and the second buffering protrusions protruding inside the second insertion support recesses are fixedly inserted into the support recesses.

The second buffering body may have a recess-shaped second elastic hole which is formed in the central portion in the direction toward the body, the space of the second elastic hole being to be deformed by elasticity, second slopes which are inclined in directions from the central portion of the surface facing outward of the body toward both sides and toward the body, and a second buffering hole which is formed in the central portion in an outward direction of the body. The second buffering body is insertable into the support space as an inner portion of the second elastic hole is deformed by elasticity when the second buffering protrusions pass through the insertion spaces. When the receptacle is pulled out, the second buffering bodies at one side and the other side come into contact with the sliding rails, such that an impact is dispersed at the second slopes and is absorbed to the second buffering hole as the inner portion of the second buffering hole is deformed.

The retainer may further include buffering fixing parts which are arranged at one side and the other side of the body, each of which transversally extends to connect opposing surfaces, which are spaced apart in an outward direction of the body, such that a fixing insertion space is formed in the buffering insertion recess in a closing direction of the body. The buffering fixing parts are disposed in a state in which the buffering fixing parts are inserted into the fixing insertion spaces such that the third buffer members are positioned inside by passing through the fixed slopes.

Each of the third buffer members may include: a third buffering body which is disposed either at one side or the other side of the body, and has a buffering insertion space at a position which is open to a corresponding one of the buffering insertion recesses, wherein both sides of the buffering insertion space and one portion of the buffering insertion space in a direction toward the body are open, such that the buffering fixing part is positioned inside the buffering insertion space when the third buffer member is inserted into the buffering insertion recess; and third buffering protrusions which protrude from one end of the third buffering body in the direction toward the body, and are distanced in a central direction at opposing positions of one end of the buffering insertion space in the direction toward the body, such that the third buffering protrusions are inserted into the fixing insertion space when the third buffer member is inserted into the buffering insertion recess. When the third buffering protrusions of the third buffering body are fixedly inserted into the buffering insertion space through the fixed slopes and around the buffering fixing part, the third buffering body is fixed in a state in which the buffering fixing part is positioned inside the buffering insertion space.

The third buffering body may have a third slope which is formed on an outer surface of the body, a cross-sectional area of the third slope being small at a central portion and increasing in a direction toward the body, and a third buffering hole which is formed in a central portion in an outward direction of the body, third buffering hole having defined a space therein. When the receptacle is pulled out, the third buffering body at one side and the other side comes into contact with the sliding rails, such that an impact is dispersed at the third slope and is absorbed to the third buffering hole as an inner portion of the third buffering hole is deformed.

The body and the rolling support brackets may be made of a rigid synthetic resin material, and the buffer members may be made of a soft synthetic resin material. The body, the rolling support brackets and the buffer members are injection-molded by an injection-molding method for a heterogeneous material. Each of the buffer members has a buffering recess which is recessed in the direction toward the body 111 from the outer surface of the body, the buffering recess is open in an outward direction of the body, when the movable rail is pulled out, the fixed protrusion and the movable protrusion abut against the buffering recesses, which are then deformed, thereby providing a buffering action, and the buffer members return to an original position in a closing action.

The retainer may further include rolling supports. The rolling supports include rolling support protrusions which protrude from opposing inner surfaces of the rolling supports, and protrude toward an outer circumference of the rolling insertion holes such that the rolling members are supported at opposing positions; and a plurality of rolling support holes which protrude from the opposing outer surfaces of the rolling supports. The rolling members are inserted into and supported by the rolling support holes which are formed at positions where the rolling support holes communicate with the rolling insertion holes which are arranged in the pulling-out direction. The rolling members are inserted into and supported by the rolling insertion holes which are arranged in the pulling-out direction of the rolling supports, the rolling members are supported by the rolling support protrusions, which are formed in the opposing inner surfaces of the rolling supports, and the rolling support holes, which protrude on the opposing outer surfaces the rolling supports, so as to roll and are prevented from being dislodged.

According to embodiments of the present invention, the buffer member which is provided in the retainer which is disposed in the sliding device can buffer a pulling-out impact, thereby minimizing noise, and prevent damage due to the impact, thereby increasing the longevity of the retainer.

In addition, the buffer member is fixed such that it is not dislodged by an external force after being disposed on both sides which come into contact with the rails when the retainer is pulled out, and is configured such that it can be assembled and disassembled as required by a user. Accordingly, the buffer member assembled to the retainer which has the rolling member can improve the reliability of the arrangement.

Furthermore, the buffer member, which is fixed such that it is not dislodged by an external force unless required by the user after being disposed on both sides which come into contact with the rail of the retainer, is made of a soft material which can improve a buffering force. The buffer member is also elastic such that it can return to the original position even if it is deformed when it is assembled. The buffer member is deformed in response to an impact applied thereto, thereby minimizing noise while absorbing the impact, and returns to the original position when the impact is absorbed. This function can be repeatedly carried out. Accordingly, the retainer firmly stays in the assembled position, and has improved anti-noise and buffering performance.

In addition, the retainer is made of a rigid synthetic resin material in order to maintain the strength with which the rolling members are supported, and the buffer members disposed on both sides of the retainer are made of a soft synthetic resin material. The retainer and the buffer members can be integrally injection-molded, thereby improving the efficiency of molding.

DETAILED DESCRIPTION

Figure 1:
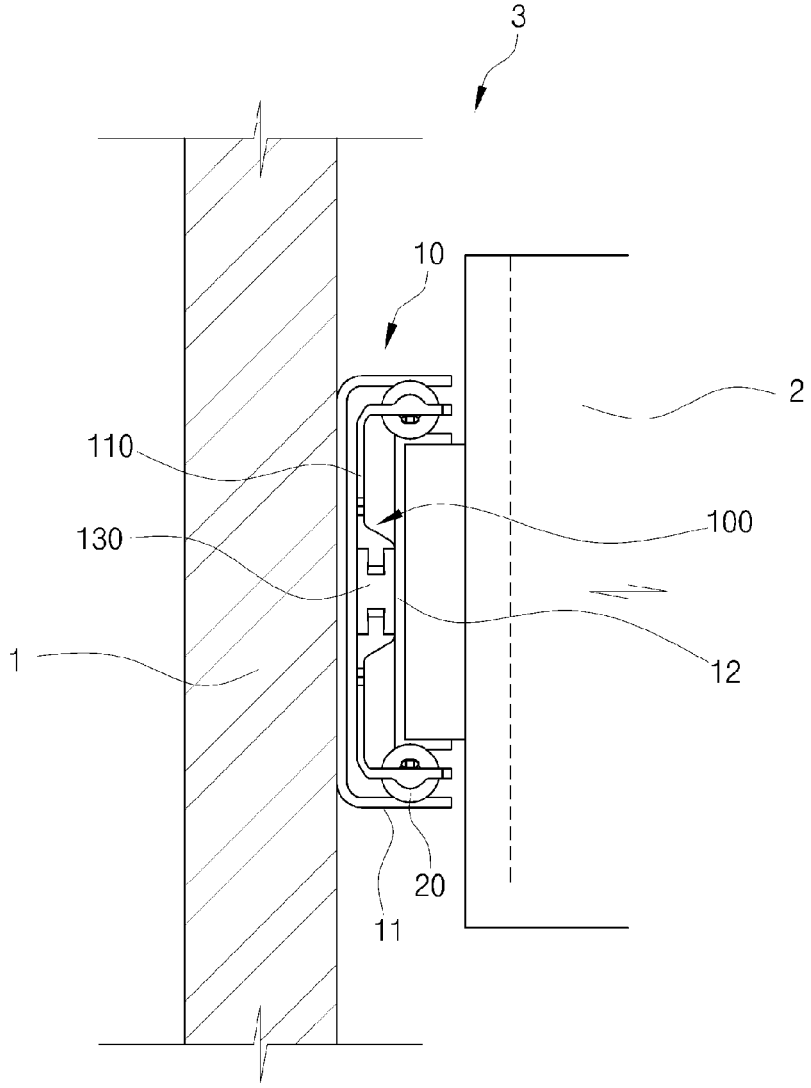
FIG. 1 a configuration view showing the state in which a retainer for a sliding device provided with a buffer member according to a first embodiment of the present invention is assembled to the sliding device, which is provided in a body and a receptacle.

Reference will now be made in detail to various embodiments of the present invention, examples of which are illustrated in the accompanying drawings and described below, so that a person having ordinary skill in the art to which the present invention relates can easily put the present invention into practice. However, the present invention can be embodied in a variety of different forms, which are not limited to the specific embodiments that will be described hereinafter. Throughout this document, the same reference numerals and signs are used throughout the different drawings to designate the same or similar components.

Reference will be made to a retainer for a sliding device provided with a buffer member according to a first embodiment of the present invention with reference to FIG. 1 to FIG. 5.

Figure 2:
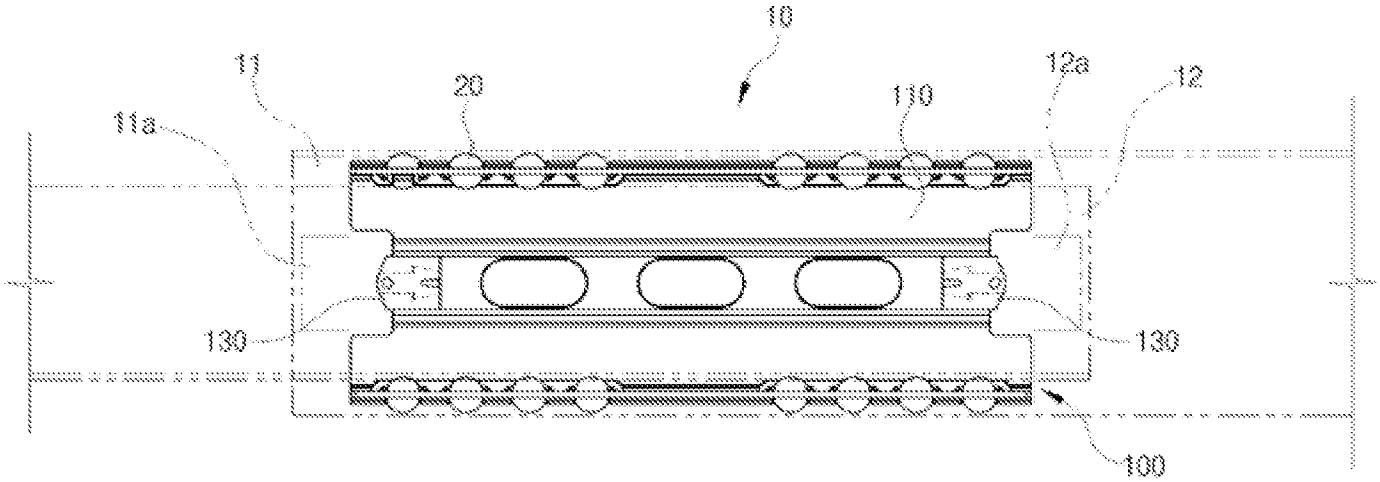
FIG. 2 is a configuration view showing the operating state of the sliding device to which the retainer for a sliding device provided with a buffer member is assembled.
Figure 3:
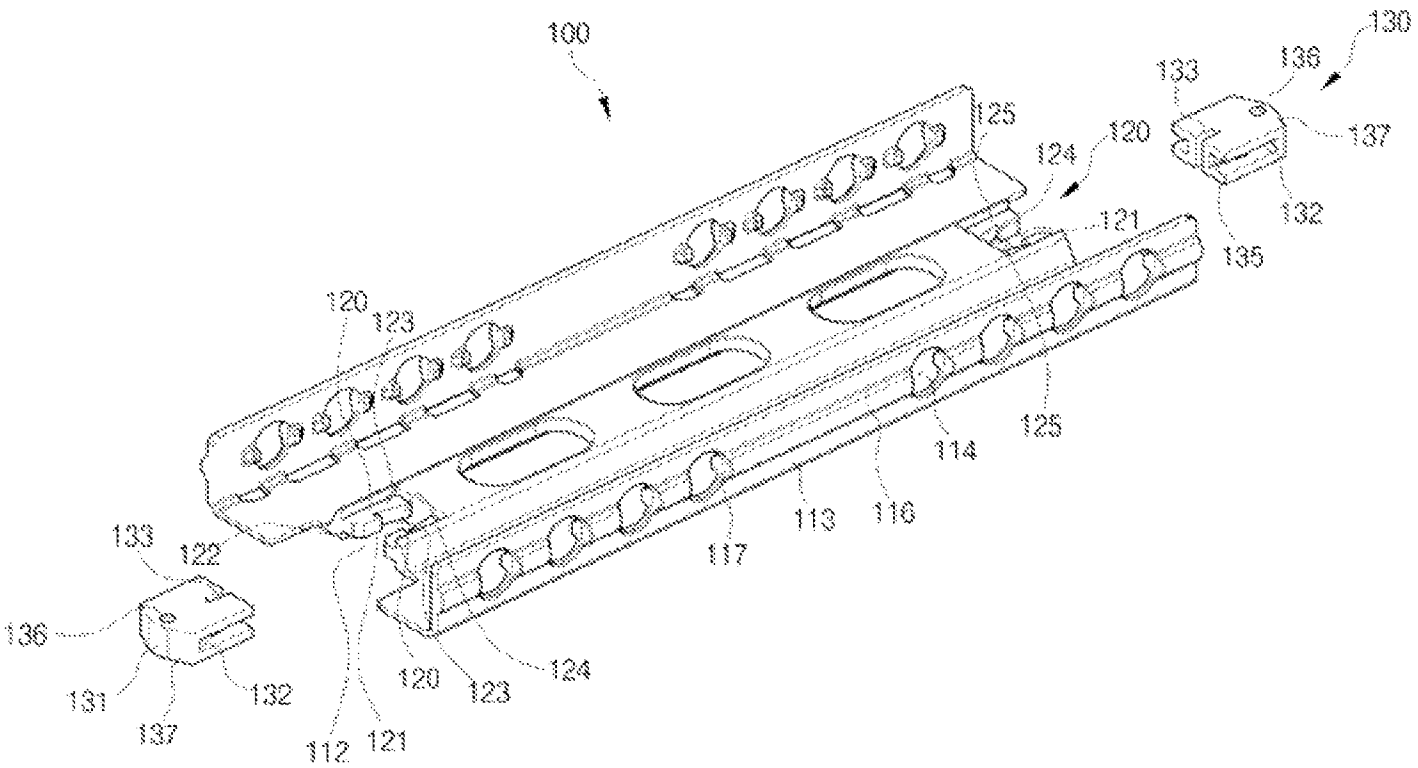
FIG. 3 is an exploded perspective view showing the retainer for a sliding device provided with a buffer member according to the first embodiment of the present invention.
Figure 4:
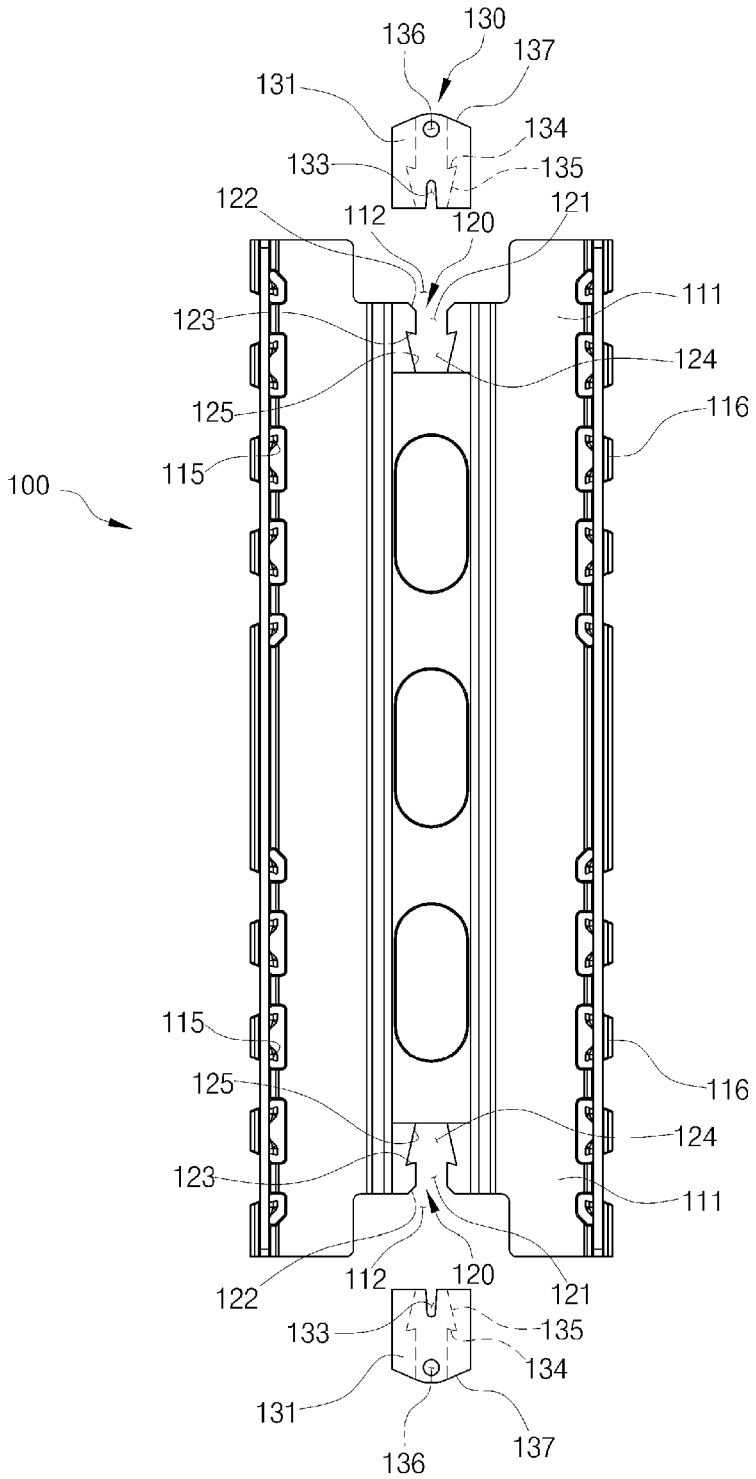
FIG. 4 is an exploded front elevation view showing the retainer for a sliding device provided with a buffer member shown in FIG. 3.
Figure 5:
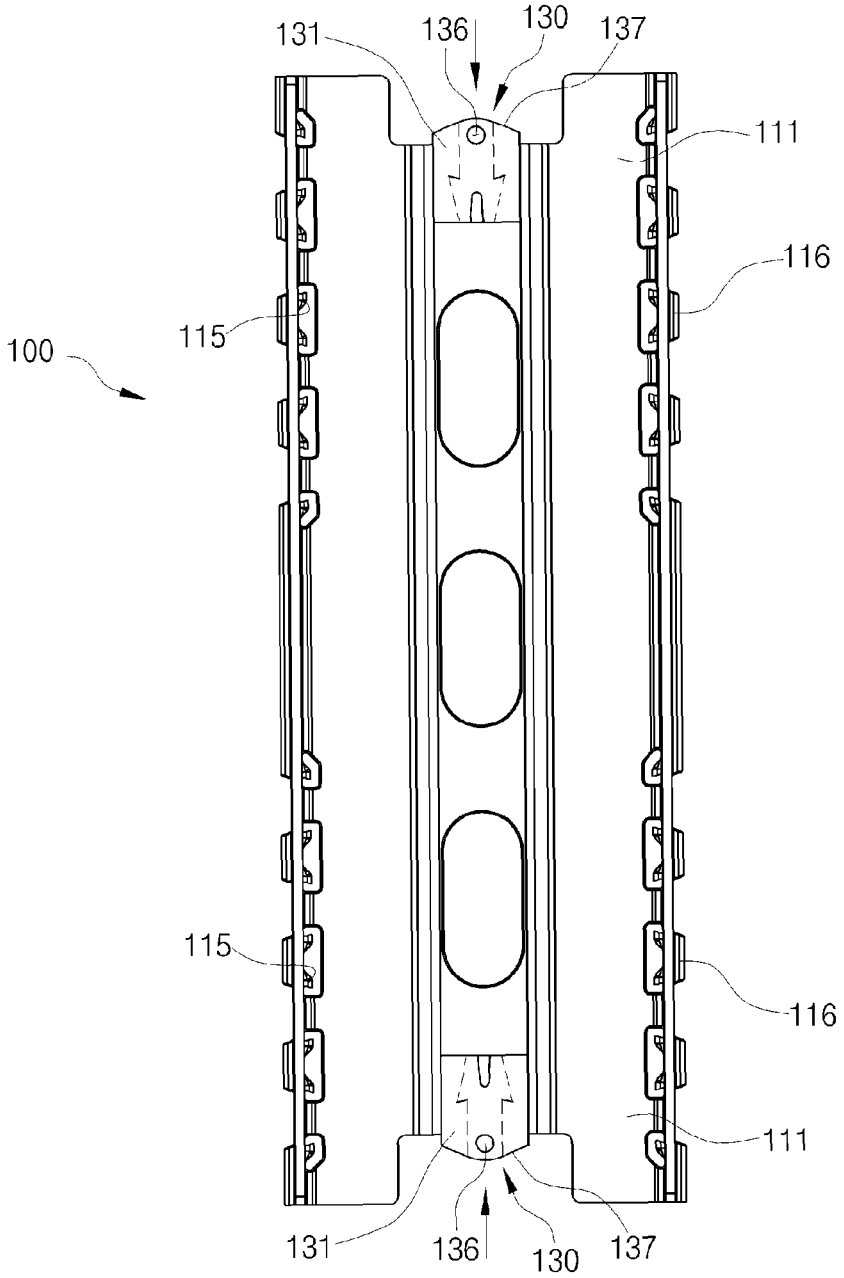
FIG. 5 is a front elevation view showing the assembly state of the retainer for a sliding device provided with a buffer member shown in FIG. 3.

FIG. 1 a configuration view showing the state in which the retainer for a sliding device provided with a buffer member according to the first embodiment of the present invention is assembled to the sliding device, which is provided in a body and a receptacle, FIG. 2 is a configuration view showing the operating state of the sliding device to which the retainer for a sliding device provided with a buffer member is assembled, FIG. 3 is an exploded perspective view showing the retainer for a sliding device provided with a buffer member according to the first embodiment of the present invention, FIG. 4 is an exploded front elevation view showing the retainer for a sliding device provided with a buffer member shown in FIG. 3, and FIG. 5 is a front elevation view showing the assembly state of the retainer for a sliding device provided with a buffer member shown in FIG. 3.

Referring to FIG. 1 and FIG. 2, a body 1, such as a piece of furniture and a refrigerator, which contains therein an object is provided with a receptacle 2 which slides such that the object is pushed in or pulled out. A sliding device 3 which slides via rolling is disposed between the body 1 and the receptacle 2.

The sliding device 3 includes sliding rails 10, a plurality of rolling members 20 and a retainer 100. The sliding rails 10 are disposed on the body 1 and the receptacle 2. The rolling members 20 are disposed between the sliding rails 10, each of the rolling members 20 being in rolling contact with the sliding rails 10 such that the receptacle 2 slides on the body when it is pulled out or closed. The retainer 100 is disposed between the sliding rails, is configured such that it contacts, interferes with, and is supported between the sliding rails 10 so that the plurality of rolling members 20 can roll. In the specification, the rolling members 20 are implemented as balls, but this is only for the sake of ease of explanation. The rolling members 20 can be implemented as any means that can roll, which include rollers.

The sliding rails include a fixed rail 11 which is fixed to the inner surface of the body 1 and a movable rail 12 which is disposed on either edge of the receptacle 2 such that it overlaps the fixed rail 11 so as to slide along the fixed rail. The rolling members 20 are disposed between the fixed rail 11 and the movable rail 12 such that they are in rolling contact with the fixed rail 11 and the movable rail 12 so as to roll. The retainer 100 is disposed in the fixed rail 11 and the movable rail 12. The retainer 100 supports the plurality of rolling members 20 in a shape that minimizes moving interference and moves together with the movable rail 12. When the receptacle 2 is pulled out, the fixed rail 11 and the movable rail 12 are held and supported at one side of the retainer in the pulling-out direction and at the other side of the retainer, in the closing direction so that the receptacle is not dislodged.

That is, the movable rail 12 which overlaps the fixed rail 11 is in rolling-contact with the retainer 100 in which the rolling members 20 are rotatably disposed at intervals such that they move when the receptacle 2 is pulled out or closed so that the rolling members 20 roll and slide thereon.

The fixed rail 11 has a fixed protrusion 11*a* at the end of one side, which prevents dislodgment. The movable rail 12 has a movable protrusion 12*a* at the end of the other side, which prevents dislodgment. When the movable rail 12, which is moved in the pulling-out direction following the pulling-out of the receptacle 2, is moved to the end of one side at which they are dislodged from the fixed rail 11, the movable protrusion 12*a* which has been moving in the state where it is supported at the other side of the retainer 100 stops being pulled out when one portion of the retainer 100 is held and supported by the fixed protrusion. That is, one side and the other side of the retainer 100 can be held and supported by the fixed protrusion 11*a* and the movable protrusion 12*a* so as to prevent the receptacle 2 from being dislodged and adjust the length to which the receptacle 2 can be pulled out.

Referring to FIG. 3 to FIG. 5, the retainer 100 for a sliding device provided with a buffer member according to the first embodiment of the present invention includes a body part 110 on which the rolling members 20 are supported, buffering supports 120 and first buffer members 130. The body part 110 includes a body 111, rolling support brackets 113, rolling support protrusions 115 and rolling supports 116 which are disposed between the fixed rail 111 and the movable rail 12. The body 111 is disposed between the fixed rail 11 and the movable rail 12, and has buffering insertion recesses 112 at one side and the other side, which are open in the outward direction such that the length to which the movable rail 12 is pulled out is adjusted. The buffering insertion recesses 112 are formed such that each outer surface thereof is opened so that the first buffer members 130 are inserted into one side and the other side by which the fixed protrusion 11*a* and the movable protrusion 12*a* are held and supported.

The rolling support brackets 113 protrude from both ends of the body 111 in two directions toward the receptacle 2 such that they are positioned in the opposing directions between the fixed rail 11 and the movable rail 12. The rolling support brackets 113 protrude in the direction in which the rolling members 20 which roll between the fixed rail 11 and the movable rail 12 are disposed.

Each of the rolling support brackets 113 has a plurality of rolling insertion holes 114 which are arranged in the pulling-out direction and into which the rolling members 20 are inserted so as to be supported thereby. The rolling insertion holes 114 are formed such that the rolling members 20 are inserted into and supported by the rolling insertion holes such that they are in rolling contact with the fixed rail 11 and the movable rail 12 so as to roll thereon.

The rolling support protrusions 115 protrude from the opposing inner surfaces of the rolling supports 116, and protrude toward the outer circumference of the rolling insertion holes 114 such that the rolling members 20 are supported at opposing positions. The rolling support protrusions 115 protrude such that the rolling members 20 are rotatably supported on the opposing inner surfaces of the rolling supports 116 and are prevented from being dislodged in the direction toward the opposing inner surfaces of the rolling supports 116.

The rolling support protrusions 115 are disposed at the opposing positions such that the intervals of the opposing surfaces which the rolling members 20 adjoin in the direction toward the rolling insertion holes 114 are formed smaller than the size of the rolling insertion holes 114 depending on the curvature of the rolling members 20, so that the rolling members 20 can roll and be prevented from being dislodged.

The rolling supports 116 have defined therein a plurality of rolling support holes 117 which protrude from the opposing outer surfaces of the rolling supports 116. The rolling members 20 are inserted into and supported by the rolling support holes 117 which are formed at positions where they communicate with the plurality of rolling insertion holes 114 which are arranged in the pulling-out direction. The rolling support holes 117 are inserted from the opposing outer surfaces of the rolling supports 116 of the rolling members 20, such that the rolling members 20 can roll while being prevented from being dislodged in the direction toward the opposing outer surfaces of the rolling supports 116.

That is, the rolling support holes 117 are formed so as to enable rolling depending on the curvature of the rolling members 20 and to be smaller than the rolling insertion holes 114, thereby preventing dislodgment in the direction toward the opposing outer surfaces of the rolling supports 116.

In other words, when the rolling members 20 are inserted into and supported by the plurality of rolling insertion holes 114 which are arranged in the pulling-out direction of the rolling supports 116, the rolling members 20 are supported by the rolling support protrusions 115, which are formed in the opposing inner surfaces of the rolling supports 116, and the rolling support holes, which protrude on the opposing outer surfaces the rolling supports 116, such that they can roll. In this fashion, the rolling members 20 can be prevented from being dislodged.

The buffering supports 120 are arranged at one side and the other side of the body 111, and protrude to distanced positions in the direction from the opposing inner surfaces toward the center such that insertion spaces 121 are formed in the buffering insertion recesses 112. The insertion spaces 121 are formed such that the first buffer members 130 supported by the buffering supports 120 are inserted thereinto. Insertion slopes 122 are formed in the buffering supports 120 in the outer direction of the body 111, and are inclined such that the insertion spaces 121 are expanded. The insertion slopes 122 are inclined at a predetermined angle, at which the insertion spaces 121 are expanded, in the outward direction of the body 111 into which the first buffer members 130 are inserted, so as to facilitate the insertion of the first buffer members 130.

In addition, the buffering supports 120 have support surfaces 123 in the direction toward the opposing surfaces of the buffering insertion recesses 112 such that the insertion spaces 121 are expanded in the direction toward the body. The buffering supports 120 also have support slopes 125 which are tapered such that the cross-sectional area decreases in the direction from both ends of the support surfaces 123 toward the body of the buffering insertion recesses 112, thereby defining support spaces 124 extending from the insertion spaces 121. The size of each support space 124 is decreased in the direction from the support surfaces 123 toward the body 111.

That is, the buffering supports 120 can be in contact with and supported by the support surfaces 123 in the state in which they have passed through the insertion spaces 121 and are inserted into the support spaces 124.

Each of the first buffer members 130 includes a first buffering body 131 and first buffering protrusions 134 which are inserted into an either one of the buffering insertion recesses 112 at one side and the other side of the body 111. The first buffering body 131 is disposed at an either one of one side and the other side of the body 111, and has first insertion support recesses 132 which are formed in both sides thereof. The first insertion support recesses 132 are opened in the direction from the opposing inner surfaces toward both sides and in the direction toward the body 111 such that a corresponding buffering support 120, which protrudes from the opposing inner surfaces of the buffering insertion recess 112 in the direction toward the center, is inserted thereinto. The first insertion support recesses 132 are formed such that the buffering support 120 which separately protrudes such that the insertion spaces 121 are formed in both sides of the first buffering body 131 is inserted thereinto.

In addition, the first buffering body 131 has a first elastic hole 133 in the central portion in the direction toward the body 1, the space of the first elastic hole 133 being to be deformed by elasticity. Since the space of the first elastic hole 133 is deformed when the buffering support 120 is inserted into the first insertion support recesses 132, the first elastic hole 133 allows the first buffering body 131 to be easily inserted into and disposed in a small space.

In addition, the first buffering body 131 has first slopes 137, which are inclined in the direction from the central portion of the surface facing outward of the body 1 toward both sides and toward the body 1, and a first buffering hole 136 which is formed in the central portion in the outward direction of the body 1. That is, when the receptacle 2 is pulled out, the first buffering bodies 131 at one side and the other side come into contact with the fixed protrusion 11*a* and the movable protrusion 12*a*, respectively, such that an impact can be dispersed at the first slopes 137 and be absorbed to the first buffering hole 136 as the inside thereof is deformed.

The first buffering protrusions 134 are formed inside the first buffering body 131 so as to protrude. Each of the first buffering protrusions 134 has a first protrusion slope 135 which protrudes from a corresponding inner surface of the first insertion support recesses 132 in the direction toward either one of the opposing surfaces of the buffering insertion recesses 112. The cross-section of the first protrusion slope 135 decreases in the direction toward the body 1 such that it comes into contact with the support surface 123 depending on the degree of inclination of the support slope 125. In this fashion, the first buffering protrusion 134 protrudes so as to be inserted into the support space 124.

That is, when the first buffering body 131 is inserted into the insertion space 121, the buffering support 120 is inserted into the first insertion support recess 132. The first buffering protrusion 134 which protrudes in the inside of the first insertion support recess 132 is deformed inside the first elastic recess 133 which is formed in the central portion, and passes through the insertion space 121 which is smaller than the erected size of the protrusion. The first buffering protrusion 134 can consequently be inserted into the support space 124 and come into contact with and be supported by the inner surface of the support space 124.

In addition, reference will be made to a retainer for a sliding device provided with a buffer member according to a second embodiment of the present invention with reference to FIG. 6 to FIG. 8.

Figure 6:
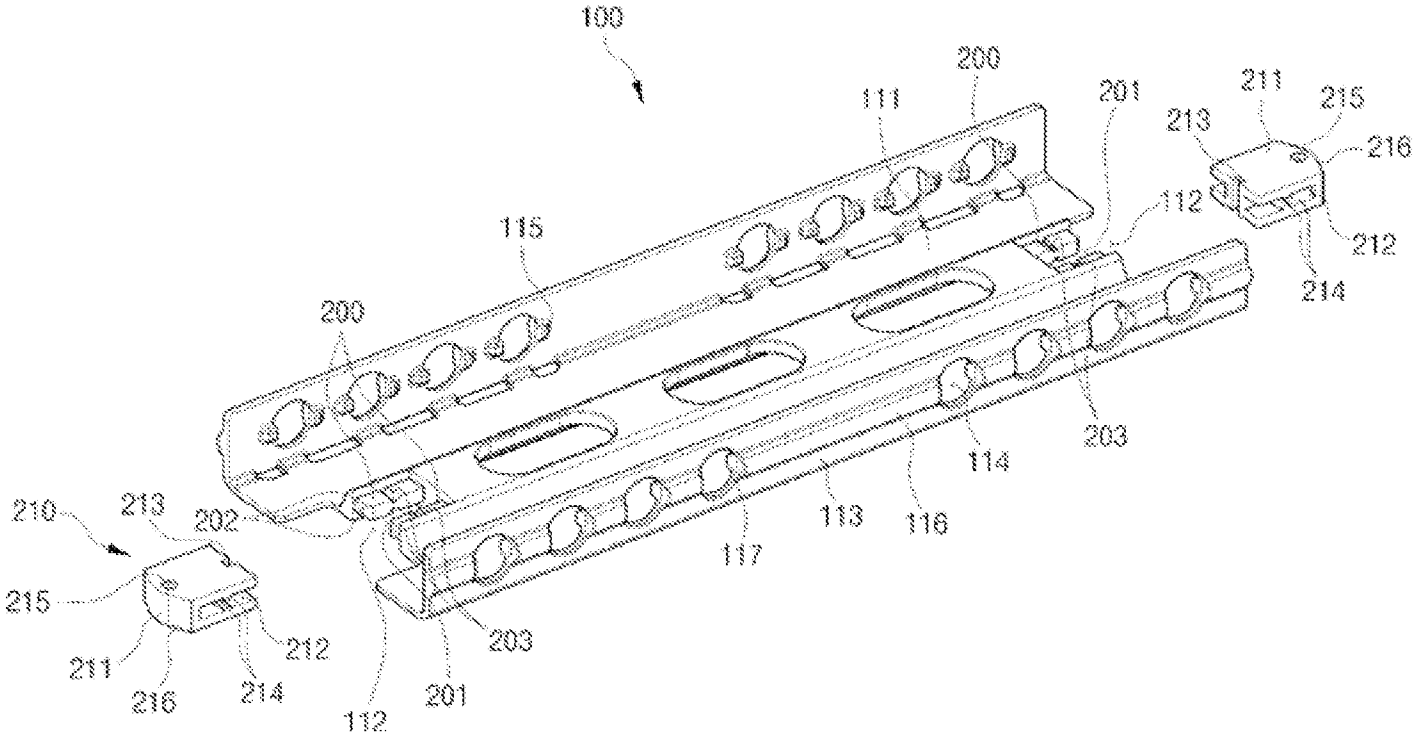
FIG. 6 is an exploded perspective view showing a retainer for a sliding device provided with a buffer member according to a second embodiment of the present invention.
Figure 7:
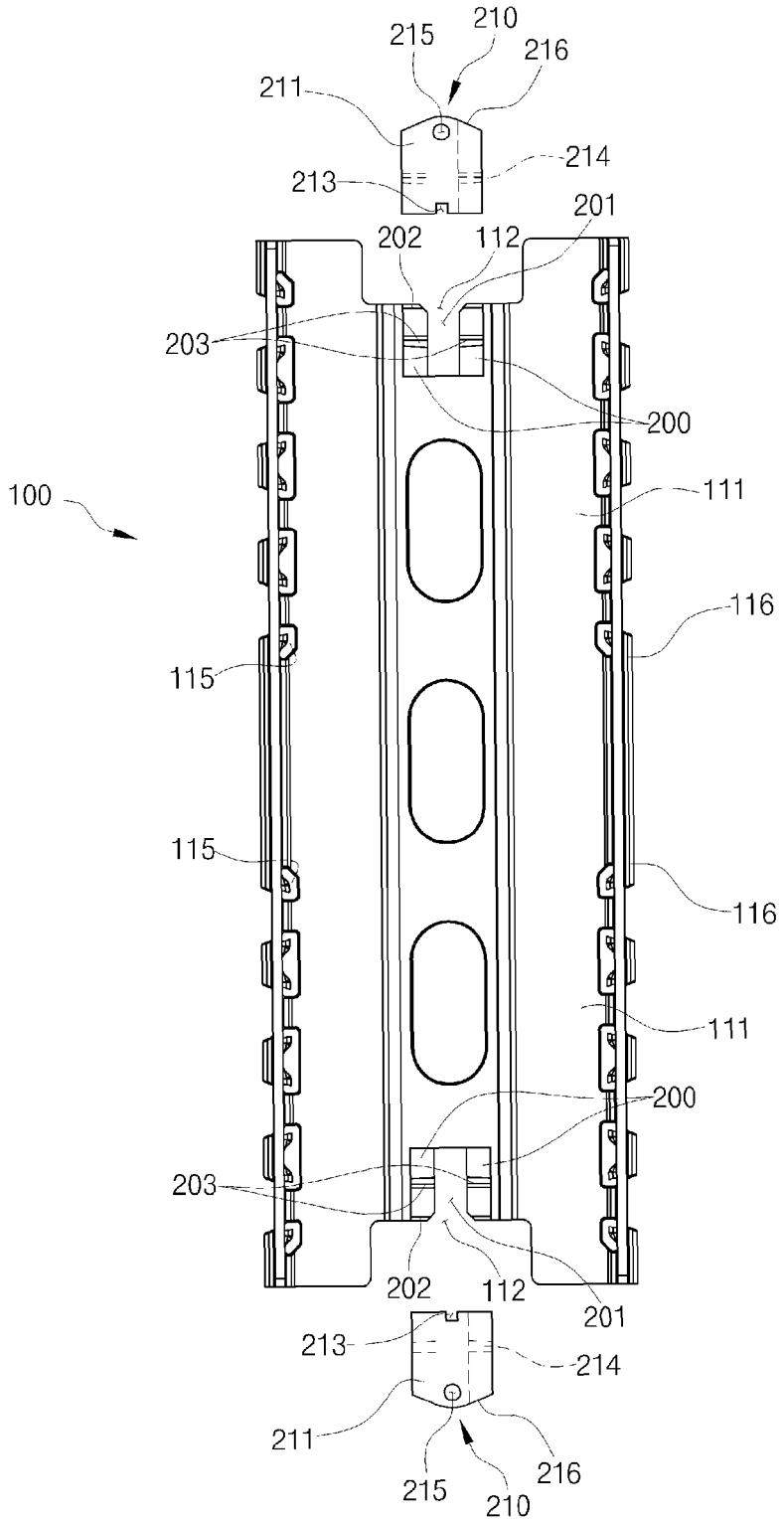
FIG. 7 is an exploded front elevation view showing the retainer for a sliding device provided with a buffer member shown in FIG. 6.
Figure 8:
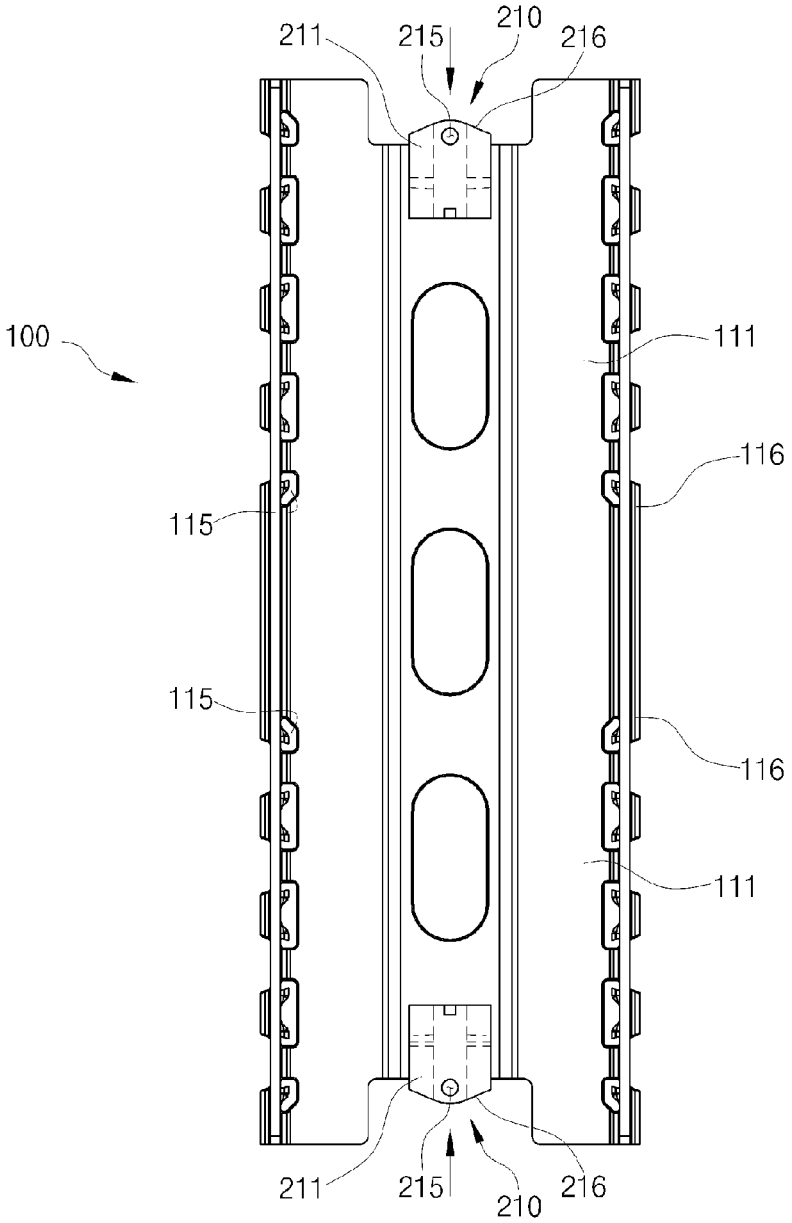
FIG. 8 is a front elevation view showing the assembly state of the retainer for a sliding device provided with a buffer member shown in FIG. 6.

FIG. 6 is an exploded perspective view showing the retainer for a sliding device provided with a buffer member according to the second embodiment of the present invention, FIG. 7 is an exploded front elevation view showing the retainer for a sliding device provided with a buffer member shown in FIG. 6, and FIG. 8 is a front elevation view showing the assembly state of the retainer for a sliding device provided with a buffer member shown in FIG. 6.

Referring to FIGS. 6 to 8, the retainer 100 for a sliding device provided with a buffer member according to a second embodiment of the present invention includes a body part 110, buffering protrusion parts 200 and second buffer members 210. Here, a description of the body 110 will be omitted since its configuration is identical with the corresponding component of the retainer 100 for a sliding device provided with a buffer member shown in FIG. 3 to FIG. 5.

The buffering protrusion parts 200 are arranged at one side and the other side of the body 111, and protrude to distanced positions in the direction from the opposing inner surfaces in the buffering insertion recesses 112 toward the center, thereby forming protrusion spaces 201. The protrusion spaces 201 are formed between the buffering protrusion parts 200 such that the second buffer members 210 are inserted thereinto.

In addition, each of the buffering protrusion parts 200 has protrusion slopes 202 on both surfaces in the direction toward the fixed rail 11 and the movable rail 12, the protrusion slopes 202 being inclined such that the cross-sectional area decreases in the outward direction of the body 1. The cross-sectional area of the protrusion slopes 202 decreases such that the second buffer members 210 can be easily inserted into the buffering protrusion parts 200.

In addition, each of the buffering protrusion parts 200 has support recesses 203 in both surfaces in the direction toward the fixed rail 11 and the movable rail 12, at the central position in the direction toward the body 1. That is, the buffering protrusion parts 200 can be disposed such that the second buffer members 210 are inserted into the protrusion spaces 201 and are inserted into the support recesses 203 which are formed in both surfaces in the direction toward the fixed rail 11 and the movable rail 12.

Each of the second buffer members 210 includes a second buffering body 211 which is inserted into an either one of the buffering insertion recesses 112 at one side and the other side of the body 111 and second buffering protrusions 214. The second buffering body 211 is arranged at an either one of one side and the other side of the body 111, and has second insertion support recesses 212 which are opened in the direction from the opposing inner surfaces toward both sides and in the direction toward the body 111 such that a corresponding buffering protrusion part 200, which protrudes from the opposing inner surfaces of the buffering insertion recess 112 in the direction toward the center, is inserted thereinto. The second insertion support recesses 212 are configured such that the buffering protrusion part 200 is inserted thereinto when the buffer member is inserted into the protrusion space 201.

In addition, the second buffering body 211 has a second elastic hole 213 in the central portion in the direction toward the body, the space of the second elastic hole 213 being to be deformed by elasticity. Since the space of the second elastic hole 213 is deformed when the buffering protrusion part 200 is inserted into the second insertion support recesses 212, the second elastic hole 213 allows the second buffering body 211 to be easily inserted into and to be disposed in a small space.

In addition, the second buffering body 211 has second slopes 216, which are inclined in the direction from the central portion of the surface facing outward of the body 1 toward both sides and toward the body 1, and a second buffering hole 216 which is formed in the central portion in the outward direction of the body 1. That is, when the receptacle 2 is pulled out, the second buffering bodies 211 at one side and the other side come into contact with the fixed protrusion 11*a* and the movable protrusion 12*a*, respectively, such that an impact can be dispersed at the second slopes 216 and be absorbed to the second buffering hole 215 as the inside thereof is deformed.

The second buffering protrusions 214 are formed inside the second buffering body 211 so as to protrude. Each of the second buffering protrusions 214 protrudes from the opposing inner surfaces of the second insertion support recesses 212 in the direction toward the central portion such that they are inserted into the support recesses 203.

That is, when second buffering body 211 is inserted into the protrusion space 201, the buffering protrusion part 200 is defined inside the second elastic hole 213 formed in the middle of the second insertion support recesses 212, such that the second buffering protrusions 214 protruding inside the second insertion support recesses 212 can be fixedly inserted into the support recesses 203.

In addition, reference will be made to a retainer for a sliding device provided with a buffer member according to a third embodiment of the present invention with reference to FIG. 9 to FIG. 11.

Figure 9:
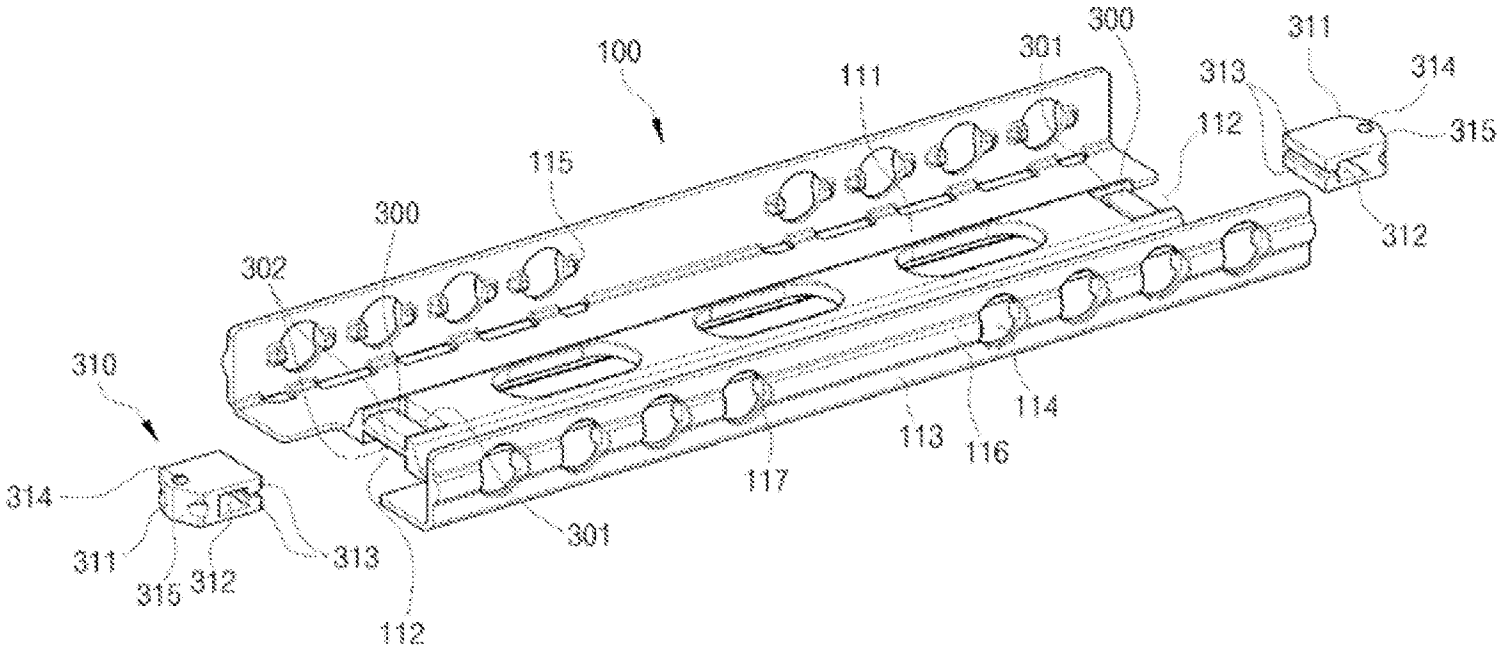
FIG. 9 is an exploded perspective view showing a retainer for a sliding device provided with a buffer member according to a third embodiment of the present invention.
Figure 10:
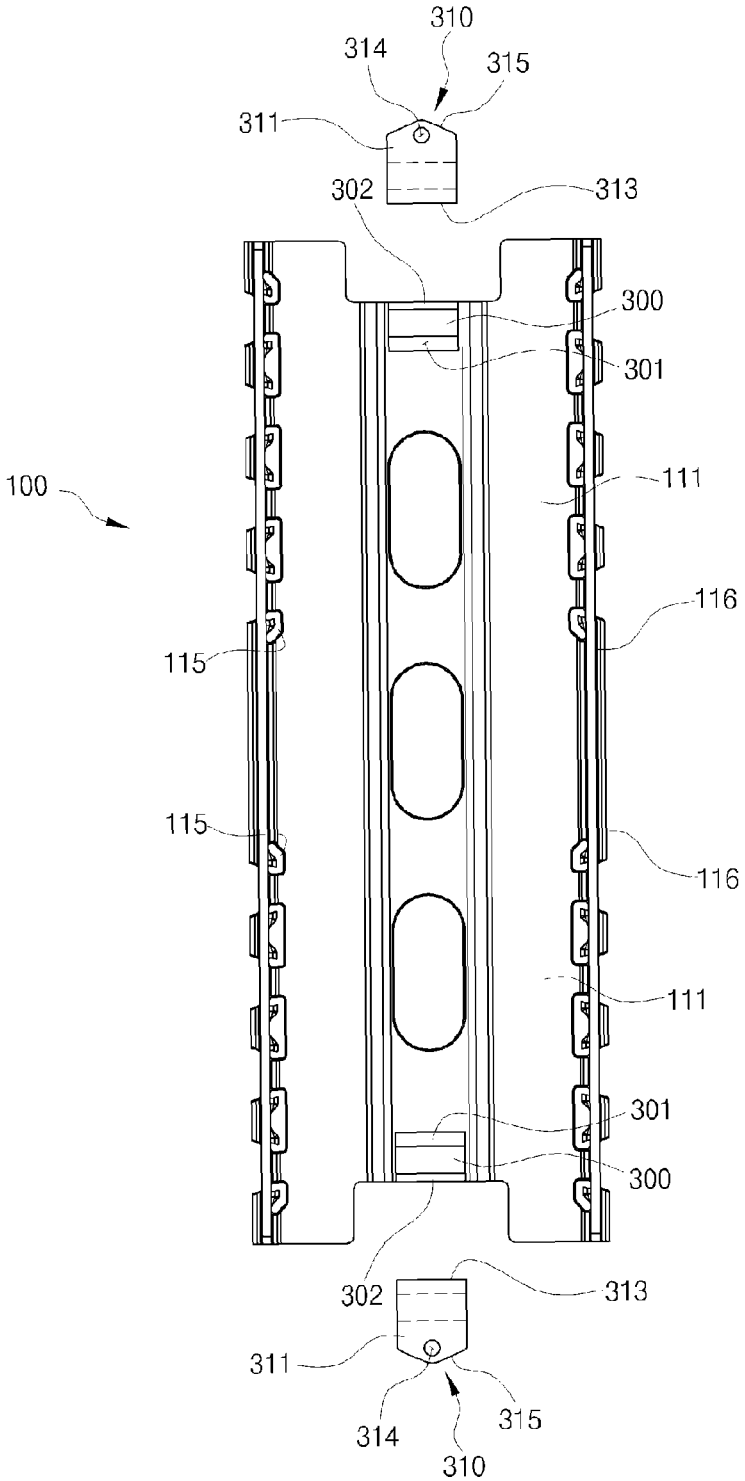
FIG. 10 is an exploded front elevation view showing the retainer for a sliding device provided with a buffer member shown in FIG. 9.
Figure 11:
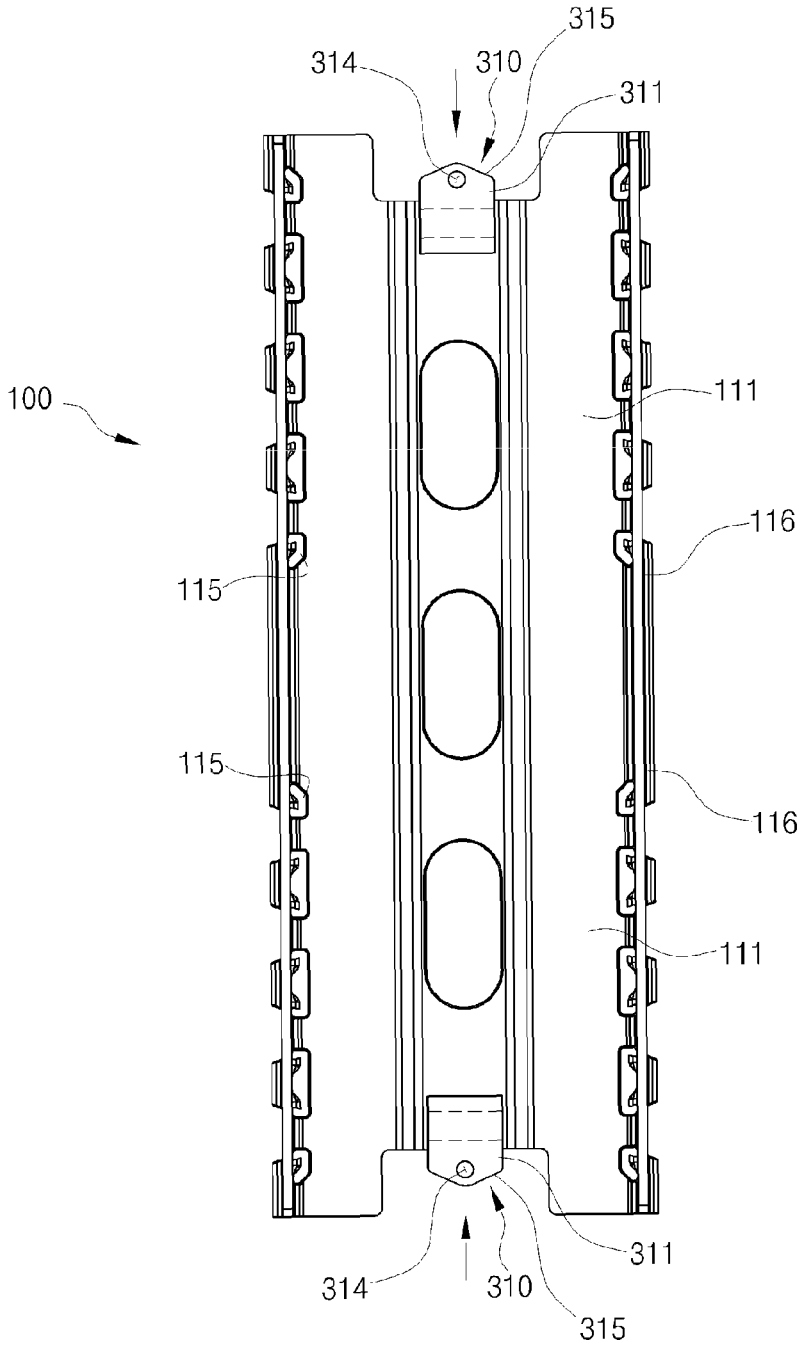
FIG. 11 is a front elevation view the assembly state of the retainer for a sliding device provided with a buffer member shown in FIG. 9.

FIG. 9 is an exploded perspective view showing the retainer for a sliding device provided with a buffer member according to the third embodiment of the present invention, FIG. 10 is an exploded front elevation view showing the retainer for a sliding device provided with a buffer member shown in FIG. 9, and FIG. 11 is a front elevation view the assembly state of the retainer for a sliding device provided with a buffer member shown in FIG. 9.

Referring to FIG. 9 to FIG. 11, the retainer 100 for a sliding device provided with a buffer member according to a third embodiment of the present invention includes a body part 110, buffering fixing parts 300 and third buffer members 310. Here, a description of the body 110 will be omitted since its configuration is identical with the corresponding component of the retainer 100 for a sliding device provided with a buffer member shown in FIG. 3 to FIG. 5.

The buffering fixing parts 300 are arranged at one side and the other side of the body 111. Each of the buffering fixing parts 300 transversally extends to connect the opposing surfaces, which are spaced apart in the outward direction of the body 1, such that a fixing insertion space 301 is formed in the buffering insertion recess 112 in the closing direction of the body 1. The buffering fixing part 300 is formed to close the buffering insertion recess 112 in the direction toward the outside of the open body 1, and defines the fixing insertion space 301 in the direction toward the body 1.

In addition, each of the buffering fixing parts 300 has fixed slopes 302 on both surfaces in the direction toward the fixed rail 11 and the movable rail 12, the fixed slopes 302 being inclined such that the cross-sectional area decreases in the outward direction of the body 1. The cross-sectional area of the fixed slopes 302 decreases such that the third buffer members 310 can be easily inserted into the buffering fixing parts 300.

That is, the buffering fixing parts 300 can be disposed in the state in which they are inserted into the fixing insertion spaces 301 such that the third buffer members 310 are positioned inside by passing through the fixed slopes 302.

Each of the third buffer members 310 includes a third buffering body 311 which is disposed either at one side or the other side of the body 111 and third buffering protrusions 313. The third buffering body 311 is disposed either at one side or the other side of the body 111, and has a buffering insertion space 312 at a position which is open to a corresponding buffering insertion recess 112. Both sides of the buffering insertion space 312 and one portion of the buffering insertion space 312 in the direction toward the body 1 are open, such that when the third buffer member is inserted into the buffering insertion recess 112, the buffering fixing part 300 is positioned inside the buffering insertion space 312.

In addition, third buffering body 311 has a third slope 315, which is inclined in the direction from the central portion of the surface facing outward of the body 1 toward both sides and toward the body 1, and a third buffering hole 314 which is formed in the central portion in the outward direction of the body 1. That is, when the receptacle 2 is pulled out, the third buffering bodies 311 at one side and the other side come into contact with the fixed protrusion 11*a* and the movable protrusion 12*a*, respectively, such that an impact can be dispersed at the third slope 315 and be absorbed to the third buffering hole 314 as the inside thereof is deformed.

The third buffering protrusions 313 protrude from one end of the third buffering body 311 in the direction toward the body 1, and are distanced in the central direction at opposing positions of one end of the buffering insertion space 312 in the direction toward the body 1, such that they are inserted into the fixing insertion space 301 when the third buffer member is inserted into the buffering insertion recess 112.

That is, when the third buffering protrusions 313 of the third buffering body 311 are fixedly inserted into the buffering insertion space 312 through the fixed slopes 302 and around the buffering fixing part 300, the third buffering body 311 can be fixed in the state in which the buffering fixing part 300 is positioned inside the buffering insertion space 312.

Furthermore, reference will be made to a retainer for a sliding device provided with a buffer member according to a fourth embodiment of the present invention with reference to FIG. 12 and FIG. 13.

Figure 12:
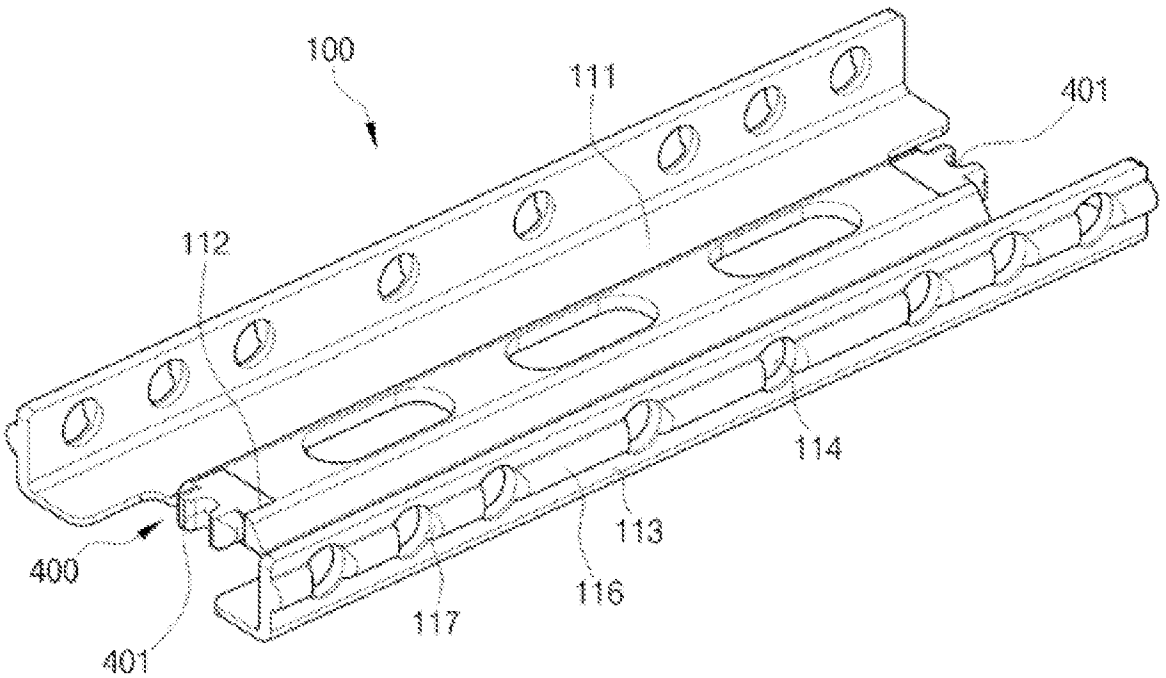
FIG. 12 is a perspective view showing a retainer for a sliding device provided with a buffer member according to a fourth embodiment of the present invention.
Figure 13:
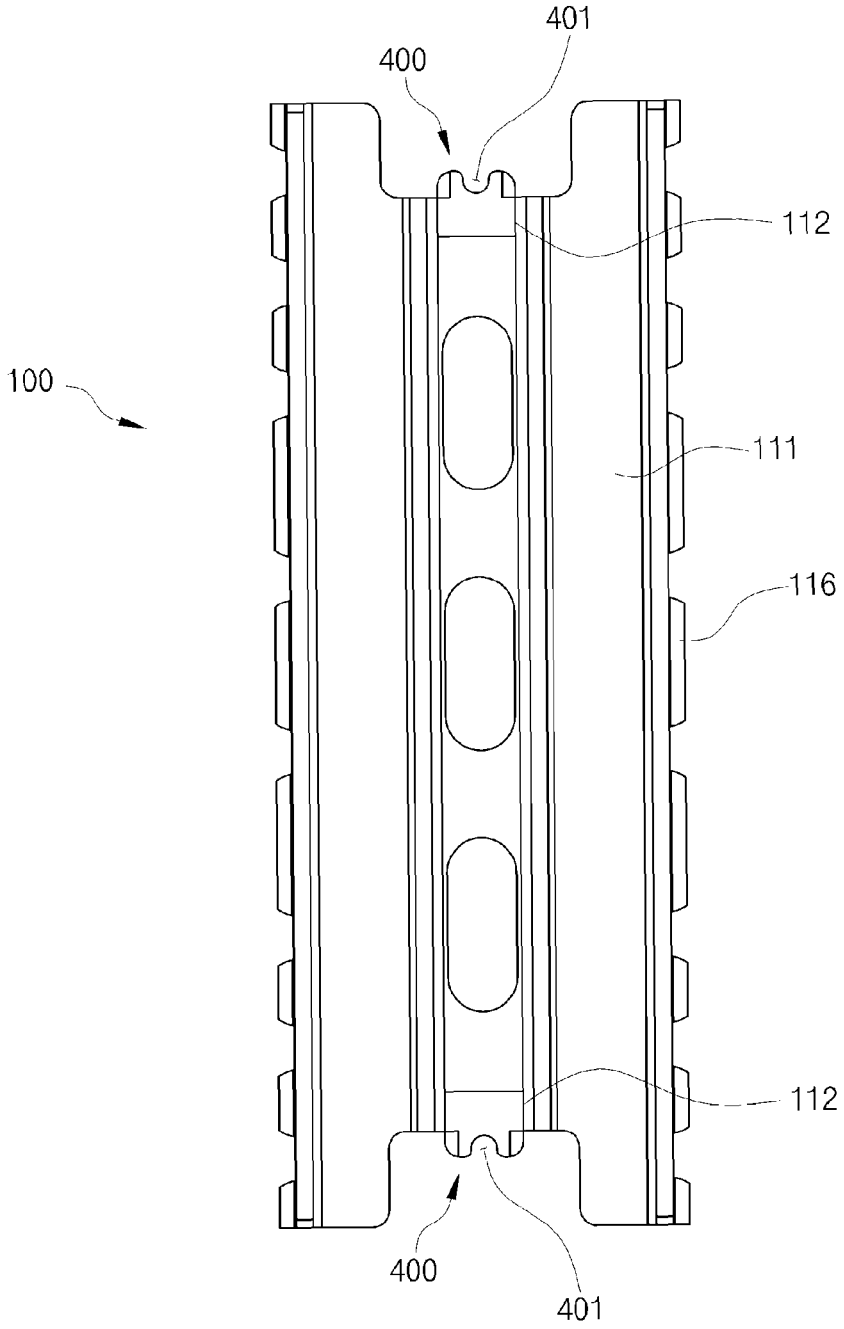
FIG. 13 is a front elevation view showing the retainer for a sliding device provided with a buffer member shown in FIG. 12.

FIG. 12 is a perspective view showing the retainer for a sliding device provided with a buffer member according to the fourth embodiment of the present invention, and FIG. 13 is a front elevation view showing the retainer for a sliding device provided with a buffer member shown in FIG. 12.

Referring to FIG. 12 and FIG. 13, the retainer 100 for a sliding device provided with a buffer member according to a fourth embodiment of the present invention includes a body part 110 and fourth buffer members 400. Here, a description of the body 110 will be omitted since its configuration is identical with the corresponding component of the retainer 100 for a sliding device provided with a buffer member shown in FIG. 3 to FIG. 5.

The body 111 of the body part 110 and the rolling support brackets 113 are made of a rigid synthetic resin material, and the fourth buffer members 400 are made of a soft synthetic resin material. The body 111, the rolling support brackets 113 and the fourth buffer members 400 are injection-molded by an injection-molding method for a heterogeneous material. Specifically, the body part is made of the rigid synthetic resin material having high strength since the rolling members are supported on the movable rail 12 so that they can roll and are to move along with the movable rail 12. The fourth buffer members 400 are made of the soft material so as to absorb an impact due to the fixed protrusion 11*a* and the movable protrusion 12 being held and supported during a pulling-out action. The body part 110 and the fourth buffer members 400 are integrally manufactured by the injection molding method for a heterogeneous material with which two synthetic resin materials can be molded at the same time, thereby reducing a processing cost. Since an assembly process is precluded, a time and cost for the assembly can be reduced.

In addition, each of the fourth buffer members 400 has a buffering recess 401 which is recessed in the direction toward the body 111 from the outer surface of the body 111. The buffering recess 401 is open in the outward direction of the body 111. When the movable rail 12 is pulled out, the fixed protrusion 11*a* and the movable protrusion 12*a* abut against the buffering recesses 401, which are then deformed, thereby providing a buffering action. At the time of closing, the fourth buffer members can return to the original position. Accordingly, the efficiency of absorbing an impact can be improved.

Although the exemplary embodiments of the present invention have been described for illustrative purposes, the scope of protection of the present invention is not limited thereto. It should be understood that those skilled in the art will appreciate that various modifications, additions and substitutions are possible, without departing from the scope and spirit of the present invention as disclosed in the accompanying claims.

[Industrial Applicability]

According to the present invention, since the buffer member is disposed in the retainer which is disposed in the sliding device so as to buffer an impact, it is possible to minimize noise, prevent damage caused by impact, and thus improve the durability of the arrangement.

The invention claimed is:

1. A retainer for a sliding device, the retainer comprising:

a body having buffering insertion recesses at both longitudinal side, the buffering insertion recesses being open in outward directions;

rolling support brackets protruding from both horizontal sides of the body, each of the rolling support brackets having a plurality of rolling insertion holes to receive rolling members;

buffering supports having support slopes and support surfaces protruding from opposing inner surfaces of the body in which each buffering insertion recess is formed to form insertion spaces, the buffering supports having support slopes and support surfaces formed in directions toward the opposing surfaces of the buffering insertion recesses to expand the insertion spaces in a direction toward the body, the support slopes tapered to decrease a cross-sectional area of each insertion spaces decrease in a direction from both ends of the support surfaces toward the body, the support slopes defining support spaces extending from the insertion spaces to the support slopes, a size of the support spaces being decreased in the direction toward the body compared to a size of the insertion spaces; and buffer members each inserted into each buffering insertion recess, each buffering member comprising a body the body of each buffer member having a first buffering hole formed in the central portion of the end part of the body of each buffer member to absorb an outside impact.

2. The retainer according to claim 1, wherein each of the buffer members comprises:

a first buffering body disposed at an either one of the longitudinal sides of the body, the first buffering body having first insertion support recesses formed in both sides of the first buffering body, the first insertion support recesses being opened in directions from the opposing inner surfaces toward both said sides and in the direction toward the body such that a corresponding one of the buffering support, which protrudes from a corresponding one of the opposing inner surfaces of the buffering insertion recess in the direction toward the center, is inserted thereinto; and first buffering protrusions which are formed inside the first buffering body, and each of which has a first protrusion slope which protrudes from a corresponding inner surface of the first insertion support recesses in a direction toward either one of the opposing surfaces of the buffering insertion recess, a cross-section of the first protrusion slope decreasing in the direction toward the body such that the first protrusion slope comes into contact with the support surface depending on a degree of inclination of the support slope, such that the first buffering protrusions protrude to be inserted into the support spaces, wherein the buffering support is inserted into the first insertion support recess when the first buffering body inserted into the insertion space, the first buffering protrusions which protrude inside the first insertion support recess are deformed inside the first elastic recesses which are formed in a central portion, and pass through the insertion spaces which are smaller than an erected size of the protrusions, such that the first buffering protrusions are inserted into the support spaces and come into contact with and are supported by inner surfaces of the support spaces.

3. The retainer according to claim 2, wherein the first buffering body has a recess-shaped first elastic hole which is formed in the central portion in the direction toward the body, the space of the first elastic hole being to be deformed by elasticity, first slopes which are inclined in directions from the central portion of the surface facing outward of the body toward both sides and toward the body, and the first buffering hole, whereby the first buffering body is insertable into the support space as an inner portion of the first elastic hole is deformed by elasticity when the first buffering protrusions pass through the insertion spaces, and the outside impact is dispersed at the first slopes and is absorbed to the first buffering hole as the inner portion of the first buffering hole is deformed.

4. The retainer according to claim 1, further comprising rolling supports which comprise:

rolling support protrusions which protrude from opposing inner surfaces of the rolling supports, and protrude toward an outer circumference of the rolling insertion holes such that the rolling members are supported at opposing positions; and a plurality of rolling support holes which protrude from the opposing outer surfaces of the rolling supports, wherein the rolling members are inserted into and supported by the rolling support holes which are formed at positions where the rolling support holes communicate with the rolling insertion holes which are arranged in the pulling-out direction, wherein the rolling members are inserted into and supported by the rolling insertion holes which are arranged in the pulling-out direction of the rolling supports, the rolling members are supported by the rolling support protrusions, which are formed in the opposing inner surfaces of the rolling supports, and the rolling support holes, which protrude on the opposing outer surfaces the rolling supports, to roll and are prevented from being dislodged.

5. A sliding device comprising:

sliding rails;

a plurality of rolling members supported between the sliding rails; and the retainer of claim 1 to slide on sliding rails, wherein the body of the retainer is disposed between the sliding rails, the rolling support brackets coupled to the sliding device such that the rolling support brackets are positioned in opposing directions between the sliding rails;

each of the rolling support brackets has a plurality of rolling insertion holes which are arranged in a pulling-out direction and into which the rolling members are inserted so as to be supported thereby; and the buffer members disposed at an end in the pulling-out direction and at an end in a closing direction of the sliding rails, wherein the buffer members are held and supported when the one sliding rail which is in rolling-contact with the rolling members is pulled out, thereby buffering an impact that is caused by a pulling-out force when the body is held and supported.

* * * * *